United States Patent [19]

O'Brien

[11] 4,145,055

[45] Mar. 20, 1979

[54] GOLF TRAINING DEVICE

[76] Inventor: John P. O'Brien, 175 E. Delaware Pl., Chicago, Ill. 60611

[21] Appl. No.: 834,293

[22] Filed: Sep. 19, 1977

Related U.S. Application Data

[63] Continuation-in-part of Ser. No. 661,779, Feb. 26, 1976, abandoned.

[51] Int. Cl.² ..... A63B 69/36

[52] U.S. Cl. ..... 273/187 B; 36/127; 36/135

[58] Field of Search ..... 273/32 C, 187 B, 188 R, 273/188 A, 183 B; 36/127, 132, 134, 135

[56] References Cited

U.S. PATENT DOCUMENTS

| | | | |
|---|---|---|---|
| 2,722,062 | 11/1955 | Phillips | 36/127 X |
| 3,020,654 | 2/1962 | McCann | 36/135 X |
| 3,218,734 | 11/1965 | O'Brien | 273/187 B |
| 3,840,229 | 10/1974 | Phillips | 36/127 X |
| 3,964,180 | 6/1976 | Cortese | 36/135 |

*Primary Examiner*—George J. Marlo

*Attorney, Agent, or Firm*—Cook, Wetzel & Egan, Ltd.

[57] ABSTRACT

A golf training device, preferably simulating a conventional golf ball with respect to size and shape is provided with an annular magnet adapted to removably attach the training device to a spike of a golf shoe.

4 Claims, 3 Drawing Figures

GOLF TRAINING DEVICE

This application is a continuation-in-part of copending application Ser. No. 661,779, filed Feb. 26, 1976, now abandoned.

The present invention relates to a golf training device, and more particularly a golf training device which may be readily attached to a conventional golf shoe and removed therefrom, thus enabling a golfer to practice his golf swing using the training device, but to readily remove the training device for play on the golf course.

It is well known that most individuals could play an improved game of golf if they could develop a proper and consistent swing. Books and articles have been written on the proper form of a golf swing, but simply reading a book or article on how to strike a golf ball does not inherently provide a golfer with a proper and consistent swing, nor does it provide him with the feel of a proper and consistent swing. One of the major shortcomings in the swing of golfers, and particularly among the high handicap golfers, is the tendency to sway off the ball and away from the intended target during the backswing and subsequent failure to return over the ball during the downswing. This fundamental error in the swing results in the golfer swinging from his rear foot, which frequently results in a slice, a topped shot, a smothered duckhook and other mishit shots which will be known to those having the ordinary skill in the art.

It has been recognized by golfers and particularly by golf teachers or professionals that the tendency to sway off a ball, away from the intended target, can be reduced if a golfer's rearward foot (the foot furthest from the target) is canted or tilted toward the target. The canting of the rear foot toward the target serves as a reminder to the golfer to stay over the ball during the backswing. Canting the rear foot will tend to force the golfer to keep his weight on the inside edge of his rearward foot and thus tend to reduce the chances that the golfer will transfer all of his weight to the rear foot. Canting the rear foot toward the target will permit the golfer to transfer 60 or 70% of his weight to the inside edge of the rear foot, but will result in a substantial portion of the weight remaining on the front foot even during the backswing. When the golfer's weight is thus distributed, he is able to shift his weight to the front foot during the downswing and at the same time maintain a steady head position over the ball.

In order to accomplish the canting of the rear foot toward the target, various devices have been devised. Initially, some golf teaching professionals simply suggest that their pupils place a ball under the outside edge of the rear foot. While such an expedient can be used, every time the golfer wishes to reposition his rear foot, it is necessary to reposition the golf ball under the shoe.

The prior art has suggested the use of golf shoes wherein one or both of the shoes are canted. In particular one U.S. Patent suggests that the rear foot be equipped with a shoe which is canted toward the target. However, this patent describes a shoe which is permanently raised along its outer edge. While this might achieve some of the objectives of the present invention, insofar as giving the golfer the feel of a correct swing, such golf shoes are not adapted to conversion into an ordinary set of golf shoes. Further, walking substantial distances with one shoe canted would probably be uncomfortable and might cause orthopedic problems.

Applicant's U.S. Pat. No. 3,218,734 describes a removable supporting attachment for golf shoes, wherein the removable support is adapted to be affixed to a specifically designed spike or cleat, inserted for the purpose of holding the support attachment. While this device was successful in giving a golfer the correct feel of a proper golf swing, and had the advantage of being removable, the means for attaching the support device required the use of a special spike or cleat which had certain inherent limitations.

The present invention is directed to a golf training device which is removably attached to golf shoes, wherein the training device is temporarily affixed to a conventional spike, used to practice the golf swing, and then removed from the spike and readily stored in a golf bag. More particularly, the present invention contemplates a supporting device, which preferably simulates a golf ball with respect to size and shape, i.e., spherical with a diameter of about 1.68 inches, as shown in the drawings. The golf training device is magnetically attachable to a conventional golf spike, and held in position by a magnet which has a surface complementary to the flange surrounding said golf spike.

The present invention thus provides a training device adapted to cant the rear foot into a desired attitude, which device may be readily attached to a conventional golf shoe and readily be removed therefrom, but which training device will remain in place during practice sessions. After practice the training device may be readily removed from the spike and stored in the golf bag or other golf ball storage devices.

The advantages of the present invention will become apparent from the following specification and claims and from the accompanying drawing, wherein:

Figure 1:
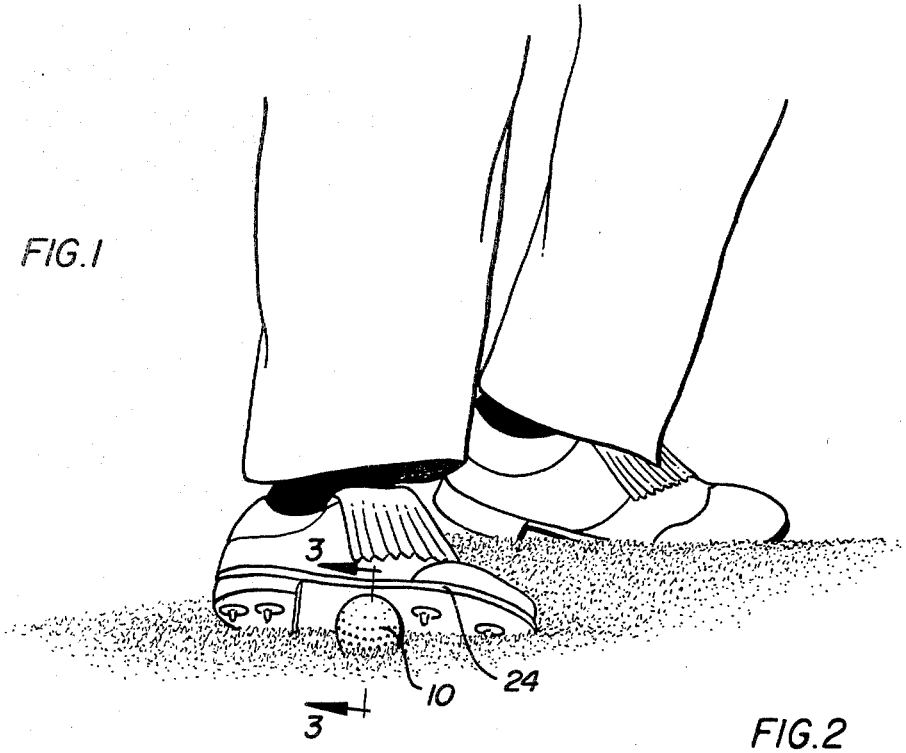
FIG. 1 is a perspective view of the golf training device of the present invention affixed in place on the outside spike or cleat of a golfer's right shoe.

The golf training device of the present invention, as it would be used by a righthand golfer, is shown in FIG. 1. The training device is placed under the outside edge of the right foot, thus canting the right foot toward the target, which lies ahead of the golfer's left side. When in place, as is shown in FIG. 1, the training device tends to cause the golfer to weight the inside edge of his right foot. Thus, when the training device is in place, any weight shifted to the right foot will tend to remain on the inside of the foot, thus minimizing the chances that the golfer will sway to the rear and off the ball, away from the target during the backswing.

Figure 2:
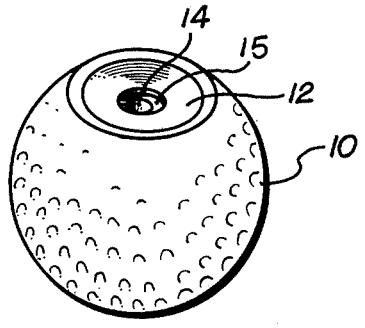
FIG. 2 is an isometric view of the golf training device, removed from the golf shoe.
Figure 3:
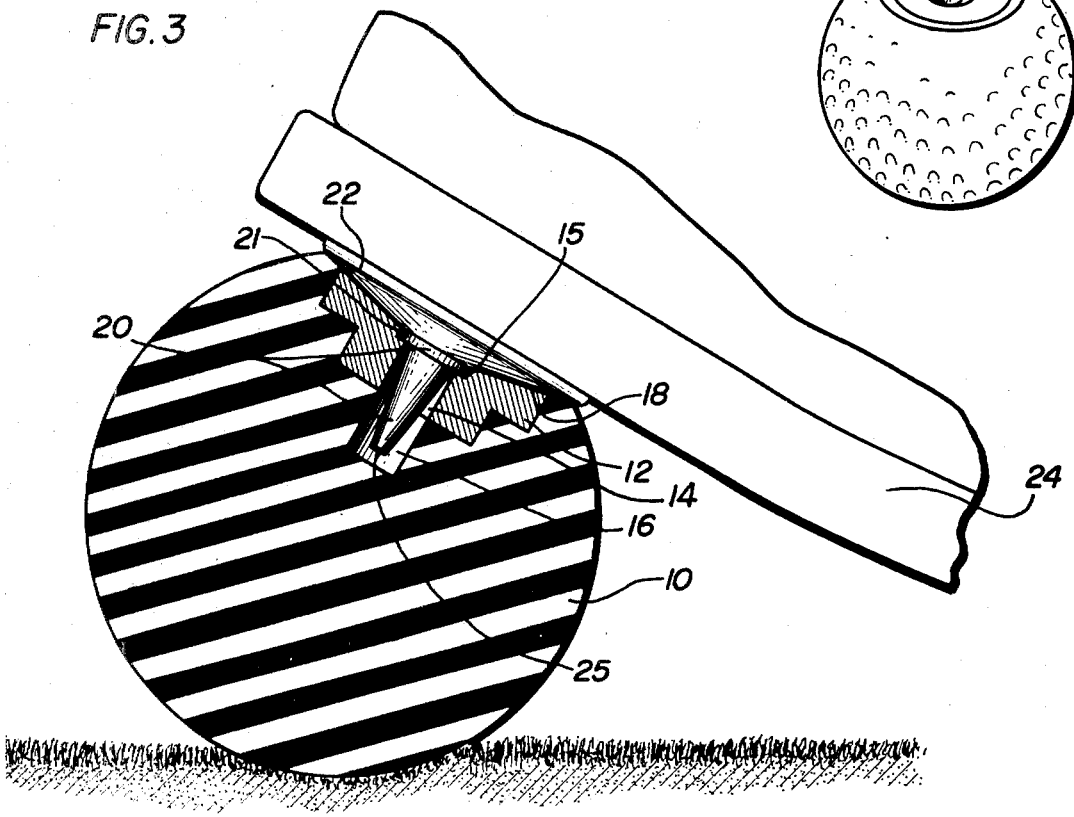
FIG. 3 is a cut-away view of the golf training device, showing the attachment in place on the spike or cleat of a golfer's shoe.

In the preferred embodiment of the present invention, the golf training device is in the general configuration, i.e., size and shape of a conventional golf ball, as is shown in FIG. 2. The United States Golf Association Rules on Golf define a golf ball as having a minimum diameter of 1.68 inches. Although the so-called "British" golf ball has a minimum diameter of 1.62 inches, for purposes of the present invention, the golf training device should have a diameter of about 1.6 inches to 1.75 inches. Such a size provides the golfer and the golf shoe with adequate support using a single golf training device, yet is a size suitable for being held by conventional golf ball storage devices. As can be seen from FIG. 3, the golf training device comprises a main support portion 10 which is adapted to rest on the ground and actually support the golf shoe in the desired, canted position. Because of the relatively large size of the preferred golf ball configuration, i.e., about 1.68 inches diameter, the penetration of the ground is fairly minimal, and a single golf training device can provide adequate shoe canting even in soft turf. Inserted in main support portion 10 is annular magnet 12. FIG. 3 shows a standard golf spike 20 mounted on the sole of a golf shoe 24 by a threaded member, not shown. The golf spike 20 includes a shank member 25 to which is attached a flange 22, which is usually a stamped steel member having a standard curvature and is permanently attached to the shank 25 of spike 20 at collar 21.

Mounted within main support portion 10 is annular magnet 12. Annular opening 14 extends axially through annular magnet 12, and is sufficiently large to permit the shank portion 25 of spike 20 to move freely therethrough. Main support portion 10 includes opening 16, axially aligned with opening 14, which permits shank 25 of spike 20 to penetrate into the support member 10 without obstruction.

Magnet 12 includes curved upper surface 18, which is complementary to the configuration of flange 22. It is deemed important that the upper surface 18 of magnet 12 be in a substantial face-to-face contact with flange 22 of spike 20 in order to provide maximum magnet attraction between the annular magnet 12 and the spike flange 22 and thus hold the training device on the golf shoe when desired.

The magnet 12 which is shown in FIG. 3 extends radially outward from shoulder 21 in substantial face-to-face contact with the surface of the spike flange 18, and preferably extends at least three-quarters of the way from shoulder 21 to the outer edge of the flange. Those skilled in the art will be aware that the amount of magnetic attraction achieved between the spike and the magnet is proportionate to the surface over which there is substantial contact. While it is generally desired to have contact between the flange and the magnet from the shoulder at least three-quarters of the way to the edge, useful products may be made with magnets having a lesser diameter. If greater magnetic attraction is required, thicker magnets may be used.

The depth of the magnet is controlled in part by the nature of the material used to form the magnet and in part by the area of the flange 22 covered by annular magnet 12. Generally, the greater the area of the spike flange covered by the magnet, the shallower the magnet may be in order to provide adequate holding power. Alternatively, deeper magnets may be used in order to provide greater magnetic attraction and greater holding power for the golf training device.

As is clearly shown in FIG. 2, it is preferred that annular magnet 12 include annular depression 15 in order to provide space for shoulder 21 of spike 20. Depression 15 may be formed in a manner to give substantial face-to-face contact between the magnet and the shoulder 21, and thus provide improved magnetic attraction between golf training device and golf shoe. Alternatively, the depression 15 may be sufficiently large to permit shoulder 21 to move in and out without obstruction and without any substantial face-to-face contact.

It is deemed essential to provide openings 14 and 16 with adequate space to permit entrance and egress of the shank portion 25 of spike 20 therefrom without obstruction or binding. It is contemplated that these two openings will receive the shank 25 of spike 20, without obstruction, even when shank 25 becomes somewhat worn or slightly bent. Therefore the tendency of the spike to wear out and wear down does not affect the ability of the golf training device to adhere to the golf shoe. Since any wear on the surface of flange 22 is minimal or nonexistent, the device of the present invention may be used with golf shoes having either new or worn spikes.

Those skilled in the art will be aware that the golf training device may be shaped in any desired configuration. While the preferred configuration which is illustrated herein comprises a size and shape simulating a golf ball which is convenient since it can be stored in conventional golf storage equipment, the golf training device may comprise various shapes, such as triangles, blocks, cylinders, and other configurations which will be known to those skilled in the art. The golf training device of the present invention preferably, for aesthetic reasons, may also have a dimpled surface and be painted white, thus enhancing its similarity to a golf ball. The support portion 10 may be fabricated from any convenient materials including plastics, metal or wood. Commercial golf balls, and particularly the so-called "solid golf balls", may be modified to receive the magnetic portion 12 if desired.

The magnetic portion 12 may be fabricated from any known magnetic material and by powdered metal molding techniques or machining or by other techniques known to those skilled in the art. The specific composition of the magnet is not critical so long as it is fabricated in a manner to provide adequate holding power.

Since women's golf shoes conventionally employ a spike having a smaller flange than the flange which is used in men's golf shoes, it may be desirable to manufacture a line of golf shoe supporting devices specifically designed for women's golf shoes, wherein the annular magnet 12 has an upper surface 18 which is shaped to complement the flange of a women's golf shoe spike. Alternatively, as is shown in FIG. 3, a golf training device wherein the magnet 12 does not extend to the full width of the outer periphery of the flange 22, of a man's golf shoe spike, a single golf training device having a universal annular magnet 12 having a universally curved upper surface 18 may be used to attach the device to a women's golf shoe cleat.

The forms of invention herein shown and described are to be considered only as illustrative. It will be apparent to those skilled in the art that numerous modifications may be made therein without departure from the spirit of the invention or the scope of the appended claims.

I claim:

1. A golf training device adapted to be removably affixed to a golf shoe, said training device comprising a support member, said support member being substantially spherical with a diameter from 1.6 to 1.75 inches, an annular magnet mounted on the upper surface of said support member, said annular magnet having an upper surface complementary to the flange of a standard golf spike, and an axial opening adapted to receive the shank of a standard golf spike.

2. A golf training device as described in claim 1, wherein said annular magnet is adapted to maintain a substantial face-to-face contact with the flange of a standard golf spike.

3. A golf training device as described in claim 1, wherein said annular magnet has a diameter equal to at least three-quarters of the diameter of the flange of a standard golf spike.

4. A golf training device as described in claim 1, wherein said support member has a general appearance similar to a golf ball.

* * * * *